United States Patent [19]

Leliaert

[11] 4,018,009

[45] Apr. 19, 1977

[54] VIBRATORY FINISHING DEVICE

[75] Inventor: Raymond M. Leliaert, South Bend, Ind.

[73] Assignee: Wheelabrator-Frye, Inc., New York, N.Y.

[22] Filed: June 9, 1975

[21] Appl. No.: 584,760

[52] U.S. Cl. ..... 51/163.2; 209/392; 209/243

[51] Int. Cl.[2] ..... B24B 31/06

[58] Field of Search ..... 51/123 V, 313; 209/392, 209/243

[56] References Cited

UNITED STATES PATENTS

| | | | |
|---|---|---|---|
| 122,485 | 1/1872 | Nicholson | 209/393 |
| 675,057 | 5/1901 | Edison | 209/243 X |
| 1,735,993 | 11/1929 | Bruce | 209/243 X |
| 3,407,542 | 10/1968 | McKibben | 51/163 V |
| 3,633,321 | 1/1972 | Rise | 51/163 V |
| 3,693,298 | 9/1972 | Ferrara | 51/163.2 |

*Primary Examiner*—Harold D. Whitehead
*Attorney, Agent, or Firm*—McDougall, Hersh & Scott

[57] ABSTRACT

A finishing device in the form of an annular bowl adapted to house media and parts to be finished and means for imparting vibratory energy to the bowl to cause the media and parts to progress in agitated movement about the bowl, means for unloading the parts without removal of media from the bowl in which use is made of barriers introduced to extend angularly into the bowl with the barriers spaced one from the other across the bowl by an amount greater than the maximum cross-section of the media but less than the cross-section of the parts whereby the parts are retained by the barriers and caused to travel up the inclined barriers while the media continues through the barriers for continued excursion about the bowl.

19 Claims, 15 Drawing Figures

VIBRATORY FINISHING DEVICE

This invention relates to a vibratory finishing device in which parts to be finished and media are subjected, in admixture, to vibratory action for the purpose of polishing, deburring, or otherwise finishing said parts.

Parts to be finished comprise a wide variety of articles including metal castings, molded plstic parts, and the like articles of manufacture, and the media may comprise an abrasive or polishing material such as granite, aluminum oxide, sand, chipped marble, steel bars, and molded plastic pellets of smaller dimension than the parts and which also may beneficially contain a fluid or finely divided polishing material in admixture with the media to form a part thereof.

When the parts and media are vibrated in admixture in said vibratory device, the resulting action causes the surfaces of the parts to be rubbed in a polishing, abrasive or abrading action.

For the most part, such vibratory devices comprise annular containers having a curvilinear bottom wall with axially spaced inner and outer side walls extending upwardly continuously from the ends of the bottom wall, with springs or other resilient means supporting the container to enable vibratory movements in response to rotation of one or more eccentrics distributed along the axis of the container. An elliptical movement is imparted to the parts and media for travel continuously down one side wall across the bottom and up the other side wall and back across the top as the parts and media are advanced circumferentially about the container. By reason of the circular configuration of the container, the parts and media can be allowed to recirculate in response to such vibratory movement until the desired surface treatment or finishing operation has been completed.

Upon completion of the finishing or abrading operation, it is necessary to separate the parts from the media for removal of the parts while the media is returned to the container for further use. Various procedures have been adopted for such separation of parts from the media. In the McKibben U.S. Pat. Nos. 3,553,900 and 3,407,542, use is made of a separation screen which overlies a portion of the bowl. When it is desired to unload the parts, an arcuate ramp is lowered into the bowl into the path of the parts and media. In response to continued vibratory action, the parts and media travel up the ramp onto the screening member. The media sifts through the screen for return gravitationally into the underlying portion of the bowl while the parts remain on the surface of the screening member from which they are carried off.

In the Ferrara U.S. Pat. No. 3,693,298, use is also made of a ramp over which the parts and media travel during vibratory movement about the bowl. When the finishing operation is completed, a screening member is inserted in endwise alignment with the ramp. The screening member retains the parts which are advanced to a delivery slot at the inner wall, while the media sifts through the screening member for return to the bowl.

In a series of Balz U.S. Pat. Nos. 3,400,495 and 3,466,815, a vertical septum or dam is located in the bowl forcing the parts and media to climb over the dam during vibratory movement in the finishing operation. Again, when the finishing operation has been completed, a screeening member is introduced at an upper level to receive the parts and media overflowing the dam to separate the parts on the surface from the media which sifts through for return gravitationally to the underlying portion of the bowl.

All of these devices depend upon the parts and media being raised to an upper level overlying a portion of the bowl for separation of the parts and return of the media gravitationally to the bowl. This operation places considerable load on the elevating ramp and screening member whereby the elements are subjected to considerable wear, requiring frequent repair and replacement and the system is subject to numerous malfunctions, such as clogging of the screens with the resultant removal of media with the parts, or breaking of the screens whereby parts return with the media to the bowl to provide incomplete separation.

It is an object of this invention to provide a vibratory device of the type described, in which, at the completion of the finishing operation, positive separtion of parts from the media can be effected in a simple and efficient manner; in which such separation can be effected with minimum wear on elements of the machine; in which the media remains continuously in the container of the vibratory device without the need to lift the media and parts to an upper level for separation by screening, and wherein such separation of parts from the media occurs automatically without removal of the media from the container or bowl.

These and other objects and advantages of this invention will hereinafter appear and for purpoes of illustation, but not of limitation, embodiments of the invention are shown in the accompanying drawings, in which.

Figure 1:
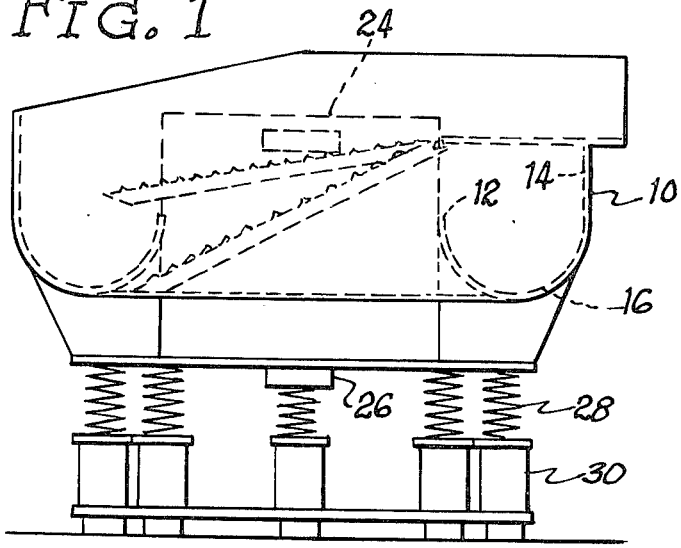
FIG. 1 is a schematic elevational view in section of a vibratory device embodying the features of this invention.
Figure 2:
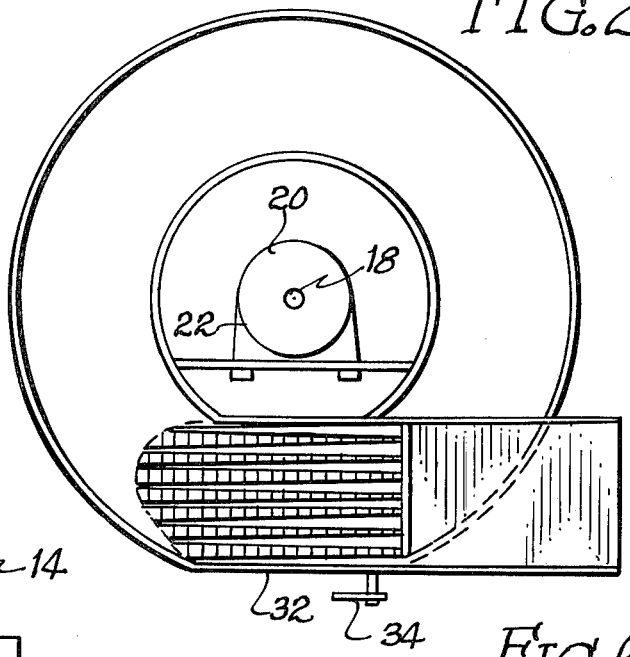
FIG. 2 is a top plan view of the vibratory device shown in FIG. 1.

Referring now to the drawings, illustration is made of a vibratory device of the type in which the features of this invention may be embodied, including a circular bowl or tub 10 having a cross-section in the form of an open top channel with a pair of axially spaced cylindrical sections which form the vertical side walls 12 and 14 joined at their lower ends by a curvilinear bottom wall 16.

Figure 3:
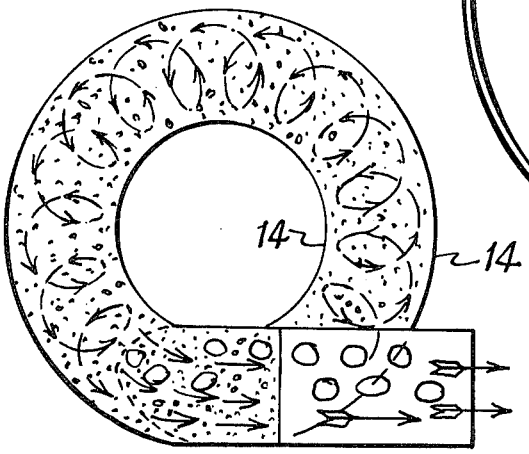
FIG. 3 is a schematic view which illustrates the movement of parts and media in the device in response to vibratory movement.

A shaft 18 extends along the vertical axis of the bowl with means mounting the shaft for rotational movement by a variable speed electrical motor 20 which is mounted by means of a suitable bracket 22 to the bowl 10. Eccentric weights 24 and 26 are fixed in vertically spaced apart relation on the shaft 18 to impart vibratory movement to the bowl in response to rotational movement of the shaft. The bowl with its supported motor, eccentrics and shaft is in turn supported by a plurality of circumferentially spaced coil springs 28 from a base 30 which enables vibratory movement of the bowl on its support. During the finishing treatment, the parts and media in the bowl are caused to travel in an elliptical path in one direction about the bowl, as illustrated by the arrows in FIG. 3.

Instead of making use of a bowl which is a complete circle, it is preferred, for purposes of accommodating the parts separation and removal means of this invention, to form the bowl with a short segment 32 which is straight, but it will be understood that the concepts of the invention can be accommodated as well in a completely circular bowl.

Briefly described, the concepts of this invention reside in the arrangement of a plurality of bars to extend across the width of the bowl in laterally spaced apart relation, with the spacing between adjacent bars dimensioned to be greater than the maximum cross-sectional dimension of the media to enable the media to pass freely between the bars, but less than the cross-sectional dimension of the parts thereby to prevent passage of the parts therebetween. Means are provided for movement of the bars as a group to raised position out of the path of the media and parts during normal operation for the surface treatment of the parts, and for movement of the bars as a group to lowered position into the bowl into the path of the parts and media at a desired angle of incline whereby, in response to continued vibratory energy, the media continues on past the bars while the parts are separated out and are caused to travel up the incline, while being supported by the bars, to a level above the media for complete and clean separation.

The angle of incline is selected to provide a resultant force in the upward direction, taking into consideration the specific gravity of the parts and the frictional factors between the surfaces, with the result that the parts will ride smoothly on the inclined bars to the upper delivery level. This angle of incline will vary somewhat depending upon the magnitude of the vibrations supplied to the bars, but more upon the specific gravity of the parts and the composition and surface finish of the parts and the supporting surfaces of the bars. The vibratory energy supplied to the bars can be derived from the vibratory bowl or from separate vibratory means connected to the bar assembly or from both.

In the modification illustrated in FIGS. 4 to 9, the bars are joined as an assembly, the upper end of which is hingedly supported by the bowl at a level above the top of the media and parts in the bowl, for rocking movement between raised position out of the path of the parts and media, as illustrated by the broken line in FIG. 1, and a lowered position into the bowl in the path of the parts and media, as illustrated by the solid lines in FIG. 1. Such rocking movement can be effected manually by means of the handle 34 or mechanically in response to electrical controls.

Figure 4:
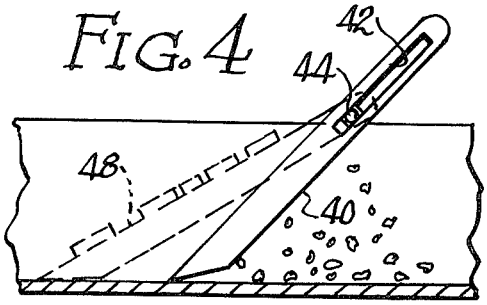
FIG. 4 is a detailed side elevational view showing one means for the separation of parts from the media in accordance with the practice of this invention.
Figure 5:
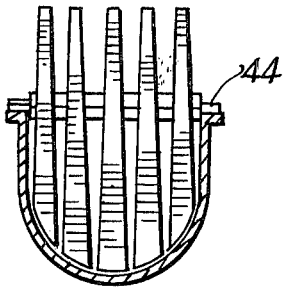
FIG. 5 is an elevational view of the modification shown in FIG. 4.
Figure 6:
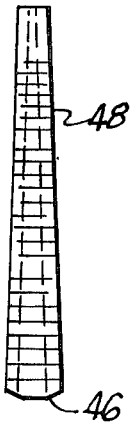
FIG. 6 is a plan view of one of the bars embodied in the modification shown in FIGS. 4 and 5.

As illustrated in FIGS. 4 to 6, the means for angular adjustment of the bars 40, for optimum use, may simply comprise an elongate slot 42 in each of the bars with the pivoted supporting rod 44 extending crosswise through the aligned slots with the rod being formed with laterally spaced apart flattened portions dimensioned slidbly to be received within the slot to enable lengthwise movement of the bars relative to the rod while being required to rock in response to turning movement of the rod between raised and lowered positions of adjustment. Thus the rod 44 represents the axis for pivotal movement of the bar assembly between raised and lowered positions. For this purpose, the end portions of the rod are journalled in suitable brackets in the upper side walls of the bowl with the handle portion 34 extending outwardly beyond the bowl for manual operation.

The basic concepts described are capable of a number of ramifications designed to facilitate rise of the parts on the upper surface of the supporting bars with a minimum of part-to-part contact or abrasion and without generating jams which might interfere with the unloading operation of the device.

In the illustrated modification, the bars 40 are of trapezoidal shape in plan view with the base 46 of larger dimension at the lower end of the bar, with the width decreasing gradually to the upper end. The bars in cross-section are also fo trapezoidal shape with base 48 of larger dimension at the upper surface or face with a gradual decrease in dimension toward the back side. Thus, the spaced relationship between the bars 40 increases gradually from the front face of the bars to the back side so that, once the media clears the space between the front faces of the bars, the media will flow freely from between the bars. Similarly, the spaced relation between the bars 40 will increase gradually toward the upper ends so that media will find its way between the bars before any media rises to the upper level.

Figure 7:
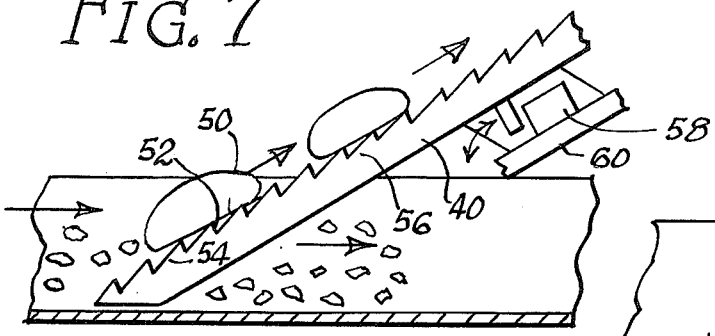
FIG. 7 is a side elevational view of a modification in the construction of the means for separation of the parts from the media.

In the modification shown in FIG. 7, the bars 40 are formed with a supporting surface having a saw-tooth configuration 50 with the upper surfaces or flat lands 52 of the teeth extending at a sharp angle, preferably at about 90°, from the plane of the surface of the bars with the trailing edge portion 54 extending from the peak gradually angularly downwardly to the surface 56. Thus a supporting surface is provided which permits the part easily to ascend the inclined bars 40 in response to vibratory energy while blocking retrograde movement down the bars, thereby to minimize part-to-part impingement during continued excrusion of the parts after separation by the bars from the media in response to continued vibratory energy. The bars 40 can be conventional elongate members having a horizontally disposed flat surface with the corrugated or saw-tooth construction, but, for best practice, use should be made of bars having the trapezoidal configuration in both plan view and in cross-section, as described in the previous modification of FIGS. 4 to 6, but with the saw-tooth configuration on the top side.

In the modification illustrated in FIG. 7, the bars 40 are interconnected at their upper ends for conjoint movement as an assembly between raised and lowered positions. The assembly is separately actuated in vibratory movement by means of a vibratory motor 58 provided with a shaft having an eccentric for imparting vibratory movement to a supporting bracket 60 which is suspended from the bottom side of the assembly at a level above the media to impart longitudinal vibrations to the bars 40 for linear displacement of the separated parts longitudinally up the supporting bar assembly.

The bar assembly may rely on the vibratory energy derived from the bowl to effect the described separation of parts from the media and for longitudinal displacement of the parts up the bar assembly but it is preferred to make use of a separate source of vibratory energy, as described above, in addition to the vibratory energy derived from the bowl to accelerate longitudinal movement of the separated parts up the bar assembly and to thereby minimize part-to-part impingement during movement while separated from the media.

Figure 8:
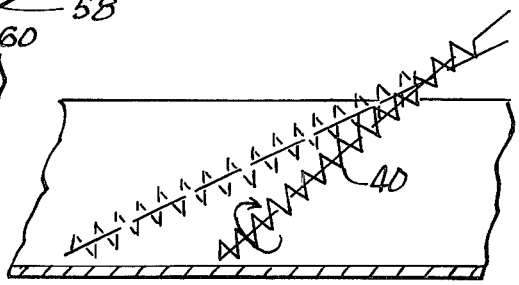
FIG. 8 is a side elevational view of a still further modification in the means for effecting the desired separation of parts from media in accordance with the practice of this invention.
Figure 9:
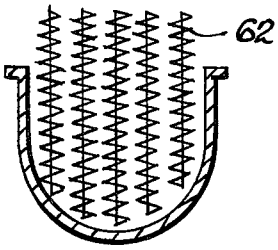
FIG. 9 is an end elevational view of the modification shown in FIG. 8.

In the modification illustrated in FIGS. 8 and 9, the bars 40 are in the form of elongate cylindrical members having a helix 62 on the outer surfaces pitched in opposite direction on adjacent bars, and mounted for rotational movement in opposite direction so that the adjacent bars will cooperate one with the other as a screw conveyor which permits free passage of the media between the bars but diverts the parts from continued excursion about the bowl. The separated parts are conveyed, in the manner of a screw conveyor, for delivery to a removal conveyor 64 at the upper level. The screw conveyor concept operates as a further supplement or completely independent of the vibratory action derived from the bowl.

Figure 12:
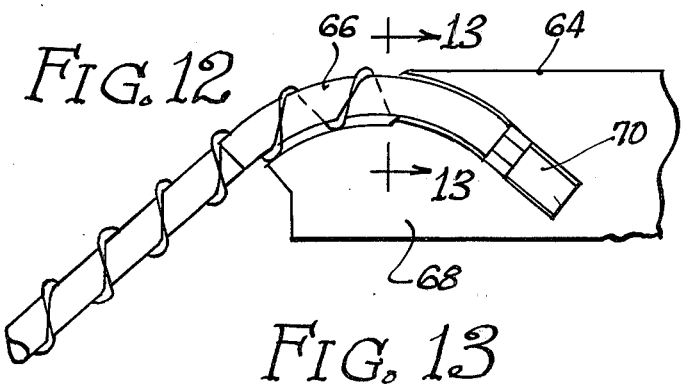
FIG. 12 is a schematic elevational view of an upper end portion of the bars in the modification shown in FIGS. 8 and 9.
Figure 13:
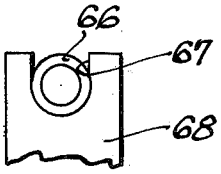
FIG. 13 is a sectional view taken along the line 13—13 of FIG. 12.

Means for rotation of the adjacent bars in opposite directions about their respective axes are shown in FIGS. 12 to 15. In FIGS. 12 and 13, the upper end portions of the bars comprise a resilient extension 66 formed of an elastomeric material, such as rubber, polyurethane or even a coil spring with the resilient portions being trained through a groove 67 in an arcuate shoe 68 and engaged for rotational movement in the desired direction by a separate motor 70. In operation, the parts separated on the surface of the cylindrical bars are conveyed by the flights of the rotating bars to the upper level for transfer onto the conveyor 64 which may be either a belt conveyor, a vibratory conveyor or the like.

Figure 14:
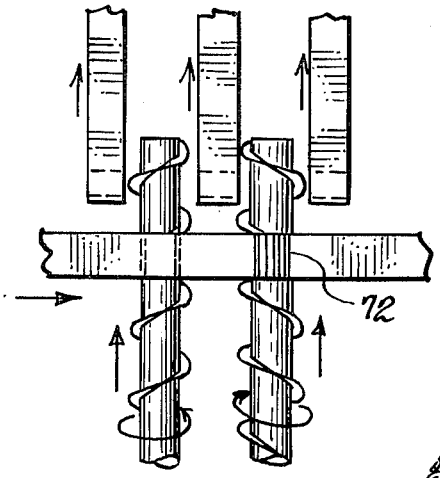
FIG. 14 is a view similar to that of FIG. 12 showing a modification in the means for directional rotation of the bars in the modification shown in FIG. 8 and 9.
Figure 15:
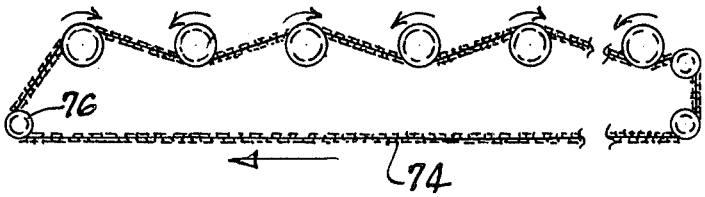
FIG. 15 schematically illustrates means for rotation of the bars of FIG. 14.

In the modification illustrated in FIGS. 14 and 15, the upper end portions of the bars are formed with a collar of smaller dimension provided with gear teeth 72 about which a continuous belt 74 (with meshing teeth on both sides) is trained, as illustrated in FIG. 15. Turning movement of adjacent bars in opposite directions is effected in response to continuous rotation of the endless belt 74 in one direction. Such rotation may be effected by means of an electrical motor, not shown, or by arranging one of the pulleys 76, about which the belt is trained, as a driving member operatively connected to a driving motor by gear means, belt or the like.

In this modification, the bars 40 can be of equal diameter throughout their lengths or they can taper as frustoconical sections from an outer end portion of larger diameter to an upper end portion of lesser diameter thereby gradually to increase the spaced relationship between the adjacent rotatably mounted bars to enhance the separating function between parts and media as previously described. The pitch of the screw flights 62 on the surfaces of the bars can vary from one group of bars to another in separate assemblies, depending somewhat upon the amount of separation desired between the separated parts and the linear speed for displacement of the parts up the support. The latter can also be adjusted by variation in the rate of rotational speed of the bars.

Figure 10:
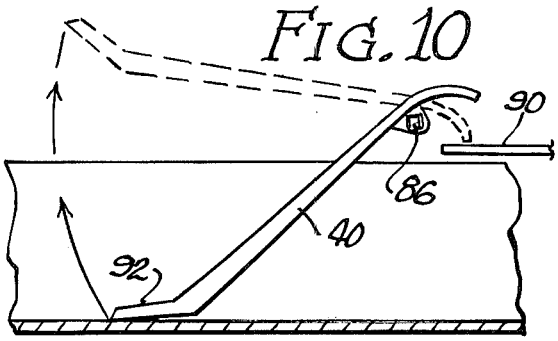
FIG. 10 is a side elevational view of a still further modification of the practice of this invention.
Figure 11:
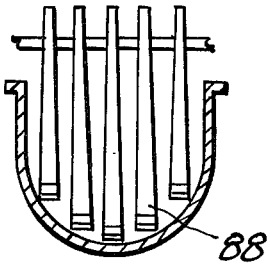
FIG. 11 is an end elevational view of the modification shown in FIG. 10.

In the modification illustrated in FIGS. 10 and 11, the bars 40 are utilized in the manner of the tines of a fork which are interconnected at their upper ends onto a horizontally disposed shaft 86 extending crosswise of the bowl at a level above the media. The tines or bars can be round, square, elliptical, rectangular or other polygonal shape, preferably, though not essentially, tapered with the larger cross section at the outer free ends 88, as illustrated in FIG. 11. The cross shaft 86 is mounted between the side walls of the bowl for rocking movement between raised and lowered positions whereby, when in the raised position, the tines are at a level to extend horizontally from the pivot, and preferably at a slight downward incline towards the pivot. When in the lowered position, the tines dip into the bowl to permit passage of the media in vibratory movement through the space between the tines, while blocking passage of the parts from continued excursion with the media. Thus when the bars are in their lowered position, the parts are withheld from passing through and, while the tines are rocked rrom lowered position to raised position, the parts are lifted from the bowl in the manner of a fork for delivery to the conveyor belt 90.

To facilitate the lifting action of the separated parts, the free outer end portions of the tines can be formed with a platform portion 92 which extends to an obtuse angle from the ends of the bars to function as a lifting platform which militates against the parts falling back into the bowl during rocking movement of the fork from lowered to raised position.

The bars 40 are of a length to come to rest on the bottom side of the bowl at the angle of repose, when in the lowered position, to effect clean and complete separation of the parts from the media and the bowl.

In the modifications described, the bars 40 will vary in length, depending on the curvature of the bottom wall of the bowl. If the bottom wall is a flat wall, the bars will be of equal length but if curved, the length of the bars will vary by an amount to enable the bar to come to rest on the bottom wall when in lowered position.

It will be understood that vibratory energy may be provided to the bowl by means other than described and that the eccentrics may be located at different positions along the axis of the bowl.

I claim:

1. In a finishing device having an annular bowl adapted to contain a charge of treating media and work pieces or parts of larger cross-sectional dimension than the media, and means for vibrating said bowl to cause the media and parts to travel circumferentially about the bowl, a means for unloading the parts without removal of the media from the bowl comprising a plurality of elongate rigid bars spaced one from the other across the bowl by an amount greater than the cross-sectional dimension of the media but less than the cross-sectional dimension of the parts, means mounting the bars for rocking movement between a raised position above the level of the parts and media in the bowl and a lowered position in which the bars extend angularly downwardly into the bowl in a direction opposite the direction of movement of the parts and media about the bowl and in which the bars are dimensioned to have a length to extend from the bottom of the bowl to a level above the parts and media in the bowl when in lowered position, whereby the media passes between the bars for continued excursion about the bowl while the parts are diverted by the bars for travel on the surfaces of the inclined bars up the incline, and a means at the upper level of the bars for receiving parts displaced on the bars to the upper level.

2. A finishing device as claimed in claim 1 in which the bars are joined as an assembly for conjoint movement between raised and lowered positions.

3. A finishing device as claimed in claim 1 in which the bars vary in length by an amount to enable the bars to extend to the bottom of the bowl, when in lowered position.

4. A finishing device as claimed in claim 1 in which the bar assembly is pivotally supported with the pivot at a level above the level of media and parts in the bowl.

5. A finishing device as claimed in claim 1 which includes means for adjustment of the angle of incline of the bars when in lowered position.

6. A finishing device as claimed in claim 5 in which the means for angular adjustment comprises an elongate slot extending lengthwise through the upper end portion of the bars and in which the support extends crosswise through the aligned slots of the bars to enable lengthwise movement of the bars relative to the support.

7. In a finishing device having an annular bowl adapted to contain a charge of treating media and work pieces or parts of larger cross-sectional dimension than the media, and means for vibrating said bowl to cause the media and parts to travel circumferentially about the bowl, a means for unloading the parts without removal of the media from the bowl comprising a plurality of elongate rigid bars spaced one from the other across the bowl by an amount greater than the cross-sectional dimension of the media but less than the cross-sectional dimension of the parts, means mounting the bars for rocking movement between a raised position above the level of the parts and media in the bowl and a lowered position in which the bars extend angularly downwardly into the bowl in a direction opposite the direction of movement of the parts and media about the bowl, whereby the media passes between the bars for continued excursion about the bowl while the parts are diverted by the bars for travel on the surfaces of the inclined bars up the incline, a means at the upper level of the bars for receiving parts displaced on the bars to the upper level, and which includes means for adjustment of the angle of inclination of the bars when in lowered position comprising an elongate slot extending lengthwise through the upper end portion of the bars and a support, in which the support comprises a crosswise extending rod which is flattened in the portions extending through the slot and in which the flattened portions have a thickness corresponding to the thickness of the slots to enable relative movement of the bars in the lengthwise direction while preventing relative rotational movement therebetween.

8. A finishing device as claimed in claim 1 in which the bars are of trapezoidal shape in plan view with the base of larger dimension at the lower end portions of the bars when measured from their lowered position thereby to provide for increasing spaced relationship between the bars from said end portion.

9. A finishing device as claimed in claim 1 in which the bars are of trapezoidal shape in cross-section with the base of larger dimension at the upper supporting surface thereby to provide for increased spaced relationship from the front surface to the back side between the adjacent bars.

10. A finishing device as claimed in claim 1 in which the bars comprise elongate cylindrical members having a helix on the outer surfaces with the helix pitched in opposition directions on adjacent bars.

11. A finishing device as claimed in claim 10 which includes means for rotating adjacent bars in opposite directions about their respective axes.

12. A finishing device as claimed in claim 10 in which the cylindrical members are frustoconical in shape, tapering inwardly from the outer ends.

13. A finishing device as claimed in claim 1 in which the supporting surfaces of the bars are in the form of saw teeth.

14. A finishing device as claimed in claim 13 in which the saw teeth are formed with flat lands facing in the upward direction and extending substantially perpendicularly from the plane of the surface.

15. A finishing device as claimed in claim 1 in which the bars are joined at their upper ends whereby the assembly resembles a fork and means mounting the fork for rocking movement between raised and lowered positions.

16. A finishing device as claimed in claim 15 which includes flanged portions extending outwardly angularly from the lower end portions of the bars in the form of platforms for support of the parts during movement from lowered to raised position.

17. A finishing device as claimed in claim 16 in which the flanged portions extend from the ends of the bars at an obtuse angle.

18. A finishing device as claimed in claim 1 in which the bars are joined into an assembly and which includes means for imparting vibratory energy to the bar assembly independent of vibratory energy derived from the bowl.

19. A finishing device as claimed in claim 18 in which the vibratory energy imparted to the bar assembly is addressed towards imparting linear movement to the parts separated on the surfaces of the bar.

* * * * *